US010164371B2

(12) United States Patent
Hara

(10) Patent No.: US 10,164,371 B2
(45) Date of Patent: Dec. 25, 2018

(54) WATERPROOF ELECTRICAL CONNECTOR WITH RETAINER FOR TERMINAL

(71) Applicant: Sumitomo Wiring Systems, Ltd., Yokkaichi, Mie (JP)

(72) Inventor: Teruo Hara, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 15/860,785

(22) Filed: Jan. 3, 2018

(65) Prior Publication Data

US 2018/0241150 A1 Aug. 23, 2018

(30) Foreign Application Priority Data

Jan. 23, 2017 (JP) ..... 2017-009472

(51) Int. Cl.

| | |
|---|---|
| ***H01R 13/514*** | (2006.01) |
| ***H01R 13/52*** | (2006.01) |
| ***H01R 13/506*** | (2006.01) |
| *H01R 13/436* | (2006.01) |
| *H01R 33/965* | (2006.01) |

(52) U.S. Cl.

CPC ..... *H01R 13/5202* (2013.01); *H01R 13/506* (2013.01); *H01R 13/4362* (2013.01); *H01R 13/52* (2013.01); *H01R 13/5205* (2013.01); *H01R 13/5219* (2013.01); *H01R 33/965* (2013.01)

(58) Field of Classification Search

CPC ..... H01R 13/5202; H01R 33/965; H01R 13/5219; H01R 13/5205; H01R 13/52; H01R 13/4362

USPC ..... 439/752, 587, 271, 595

See application file for complete search history.

(56) References Cited

U.S. PATENT DOCUMENTS

2007/0099501 A1* 5/2007 Tsuchiya ..... H01R 13/5208 439/587
2011/0086544 A1 4/2011 Yoshioka et al.
2012/0077377 A1* 3/2012 Han ..... B29C 45/2628 439/587

FOREIGN PATENT DOCUMENTS

JP 5428730 2/2014

* cited by examiner

*Primary Examiner* — Abdullah Riyami
*Assistant Examiner* — Justin Kratt
(74) *Attorney, Agent, or Firm* — Gerald E. Hespos; Michael J. Porco; Matthew T. Hespos

(57) ABSTRACT

A waterproof connector includes male terminals (20) each of which has a box-shaped body (21) and a tab-shaped contact (22) that projects forward from a front end of a box-shaped body (21). The connector also has an outer housing (40) and an inner housing (30) accommodated in the outer housing (40). A terminal accommodating portion (34) is formed in the inner housing (30). A retainer (70) is mounted into the terminal accommodating portion (34) and includes a lock (71) configured to lock rear ends of the bodies (21) accommodated in the terminal accommodating portion (34). A seal seals the interior of the outer housing (40). The retainer (70) includes a releasing portion (72) projecting forward of the terminal accommodating portion (34). The inner housing (30) includes a protection wall (38) between the contact portions (22) of the male terminals (20) and the releasing portion (71).

8 Claims, 12 Drawing Sheets

WATERPROOF ELECTRICAL CONNECTOR WITH RETAINER FOR TERMINAL

BACKGROUND

Field of the Invention

This specification relates to a waterproof connector.

Description of the Related Art

Japanese Patent No. 5428730 discloses a waterproof connector with a housing that has a cavity into which a terminal fitting is inserted and a retainer including a retaining portion for retaining the terminal fitting inserted in the cavity. The housing has an inner housing and an outer housing. The inner housing has a body and a rear end of the body has a mounting recess into which a rubber plug and a rubber plug pressing member are inserted. The rubber plug pressing member includes a pressing body with an outer shape having substantially the same cross-sectional shape as the rubber plug and two arms that project forward from the front surface of the pressing body. Tapered release interlock engaging portions are formed on lower edge tip parts of the both arms and incline down to the rear. The rubber plug pressing member can be moved rearward from a state where the rubber plug and the rubber plug pressing member are mounted properly in the mounting recess. This movement causes the release interlock engaging portions of the arms to slide in contact with release interlock portions of the retainer and moves the retainer from a full locking position to a partial locking position. Thus, there is no need for a movement of the retainer to the partial locking position and a separate movement the rubber plug pressing member rearward.

Waterproof performance of the waterproof connector is checked by conducting a test to confirm that there is no air leakage from the cavity and that an inner pressure of the cavity is a predetermined pressure when air is injected into the cavity. However, if the rubber plug is moved rearward by the inner pressure, the rubber plug pressing member also moves rearward, the release interlock engaging portions slide against the release interlock portions and the retainer moves from the full locking position to the partial locking position. Thus, a holding force for the terminal fitting is reduced.

SUMMARY

A waterproof connector disclosed by this specification includes a male terminal with a box-shaped body and a tab-shaped contact that projects forward from a front end of the box-shaped body. The waterproof connector further has an outer housing and an inner accommodated inside the outer housing. The inner housing has a terminal accommodating portion. A retainer is mounted into the terminal accommodating portion and includes a lock configured to lock the body of the male terminal in the terminal accommodating portion from behind. A seal is configured to seal the interior of the outer housing. The retainer includes a releasing portion that projects forward of the terminal accommodating portion, and the inner housing includes a protection wall disposed between the contact of the male terminal and the releasing portion. According to this configuration, the lock can be moved to release the body from the lock by inserting a tool from the front of the outer housing and operating the releasing portion. Thus, the outer housing does not need a hole for a releasing operation and waterproof performance can be ensured.

The retainer can be mounted into the terminal accommodating portion in a direction perpendicular to a projecting direction of the contact portion of the male terminal. Thus, a holding force for the male terminal is improved as compared to the case where a retainer is mounted into the terminal accommodating portion from the front.

Insertion of a tool from the front of the outer housing may cause the tip of the tool to interfere with the contact of the male terminal and can damage the contact. However, the protection wall is disposed between the contact of the male terminal and the releasing portion in the above-described configuration. Thus, the releasing portion can be moved inside the protection wall and the tip of the tool cannot erroneously contact and damage the contact of the male terminal.

The retainer may be mounted into the terminal accommodating portion from below. Additionally, the releasing portion may project forward through a hole in a lower part of the terminal accommodating portion, and the protection wall may have a U-shape that opens down when viewed from the front.

The male terminal is released by moving the lock from a position behind the male terminal to an intermediate position between two adjacent male terminals. Thus, an interval between adjacent male terminals becomes larger. Generally, a portion to be engaged by a lock is on an upper or lower side of a body of a male terminal, and an interval between two male terminals that are vertically adjacent is larger than an interval between male terminals that are laterally adjacent. Thus, if a releasing direction of the lock is vertical, the vertical interval does not become drastically larger and a significant enlargement of the terminal accommodating portion can be avoided.

The outer housing may include a rearwardly open mounting portion behind the terminal accommodating portion, and the seal may be held in the mounting portion by mounting a rear holder behind the seal in the mounting portion. Thus, the rear holder holds the seal in the mounting portion and the seal reliably seals the interior of the outer housing.

The retainer may be movable between a full locking position for holding the body of the male terminal inside the terminal accommodating portion by locking the body and a partial locking position for permitting the male terminal to be inserted and withdrawn. According to this configuration, the retainer can be moved from the full locking position to the partial locking position by operating the releasing portion by the tool.

The rear holder may include an operation pin configured to move the retainer from the partial locking position to the full locking position by engaging the retainer from behind. Thus, the retainer can be moved from the partial locking position to the full locking position merely by mounting the rear holder into the mounting portion, and an operation of moving the retainer from the partial locking position to the full locking position is not necessary. Further, the operation pin of the rear holder can be arranged by effectively utilizing a dead space formed behind the releasing portion.

According to the waterproof connector disclosed by this specification, it is possible to exhibit a sufficient holding force of the retainer while ensuring waterproof performance and avoid the damage of the contact portion of the male terminal by a releasing operation.

DETAILED DESCRIPTION

Figure 8:
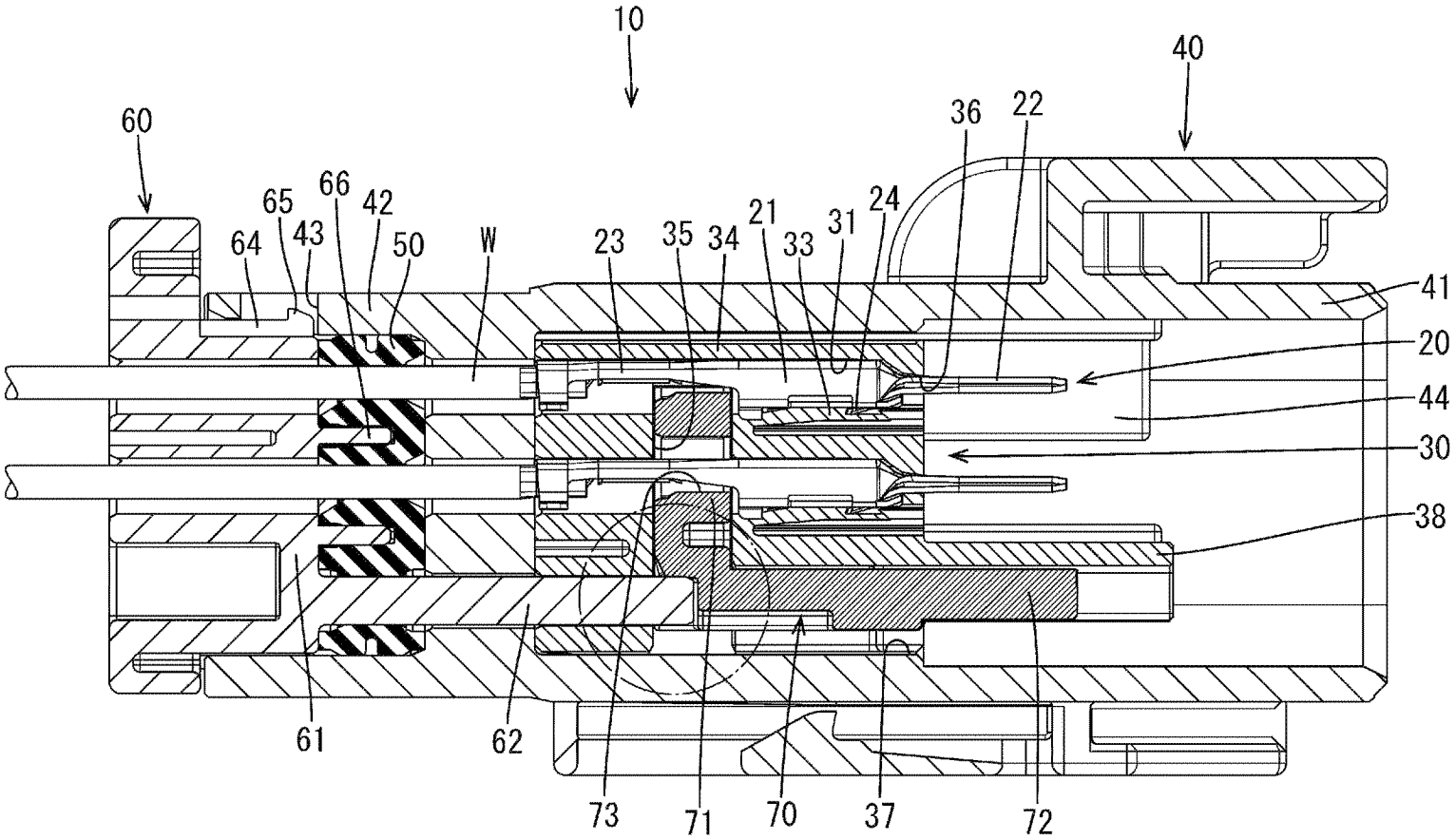
FIG. 8 is a section along B-B of FIG. 7.

An embodiment is described with reference to FIGS. 1 to 12. A waterproof connector 10 of this embodiment is shown in FIG. 8 and includes male terminals 20, an inner housing 30 for holding the male terminals 20, an outer housing 40 with the inner housing 30 mounted inside, a one-piece rubber plug 50 behind the inner housing 30, a rear holder 60 disposed behind the one-piece rubber plug 50 and a retainer 70 for retaining the male terminals 20.

Figure 1:
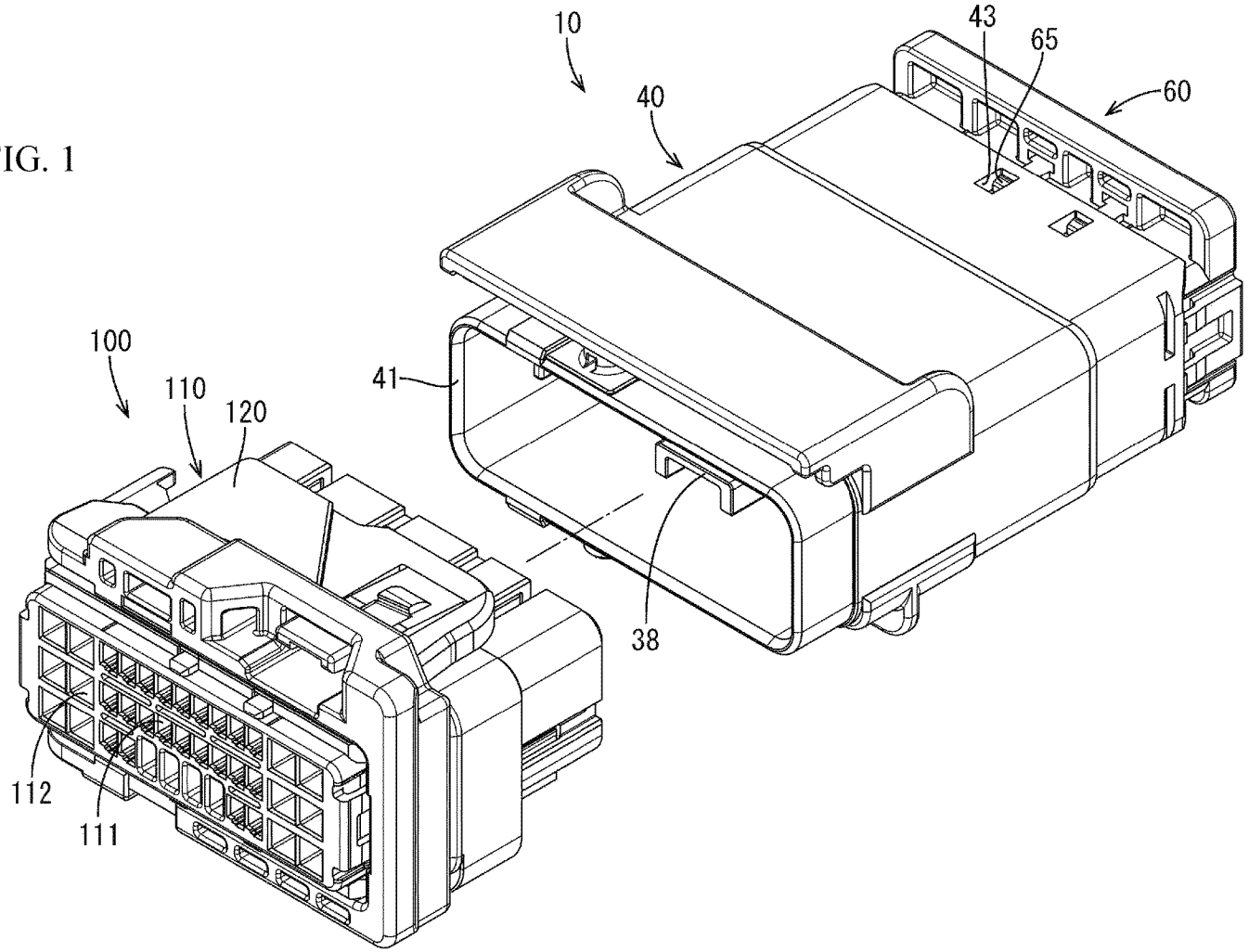
FIG. 1 is a perspective view showing a state before a mating connector is connected to a waterproof connector.
Figure 2:
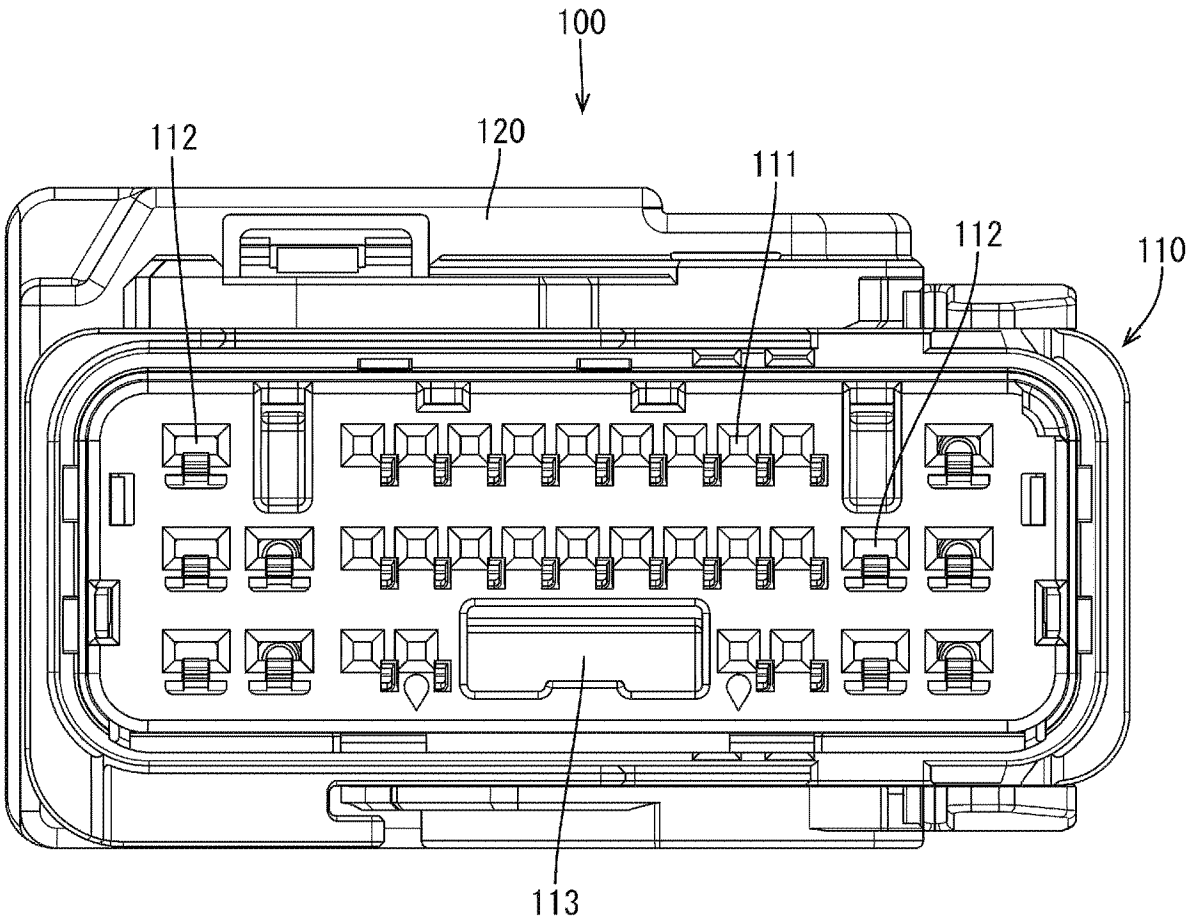
FIG. 2 is a front view of the mating connector.

A mating connector 100 is shown in FIG. 1 and is connectable to the waterproof connector 10. The mating connector 100 includes a female housing 110 made of synthetic resin, a rotatable lever 120 and female terminals (not shown) held in the female housing 110. As shown in FIG. 2, the female housing 110 has a laterally long rectangular shape in a front view and includes large and small female cavities 111, 112. The small female cavities 111 are disposed side by side in vertical and lateral directions in a central part of the female housing 110, and the large female cavities 112 are disposed at both left and right sides of the small female cavities 111. A lower central part of the female housing 110 has an escaping hole 113 that receives a releasing portion 72 and a protection wall 38 to be described later.

An unillustrated rubber ring is fit on the outer peripheral surface of the female housing 110. The rubber ring is sandwiched between the outer peripheral surface of the female housing 110 and the inner peripheral surface of the outer housing 40 to seal the interior of the outer housing 40 when the female housing 110 fit in the outer housing 40 of the connector 10.

Figure 3:
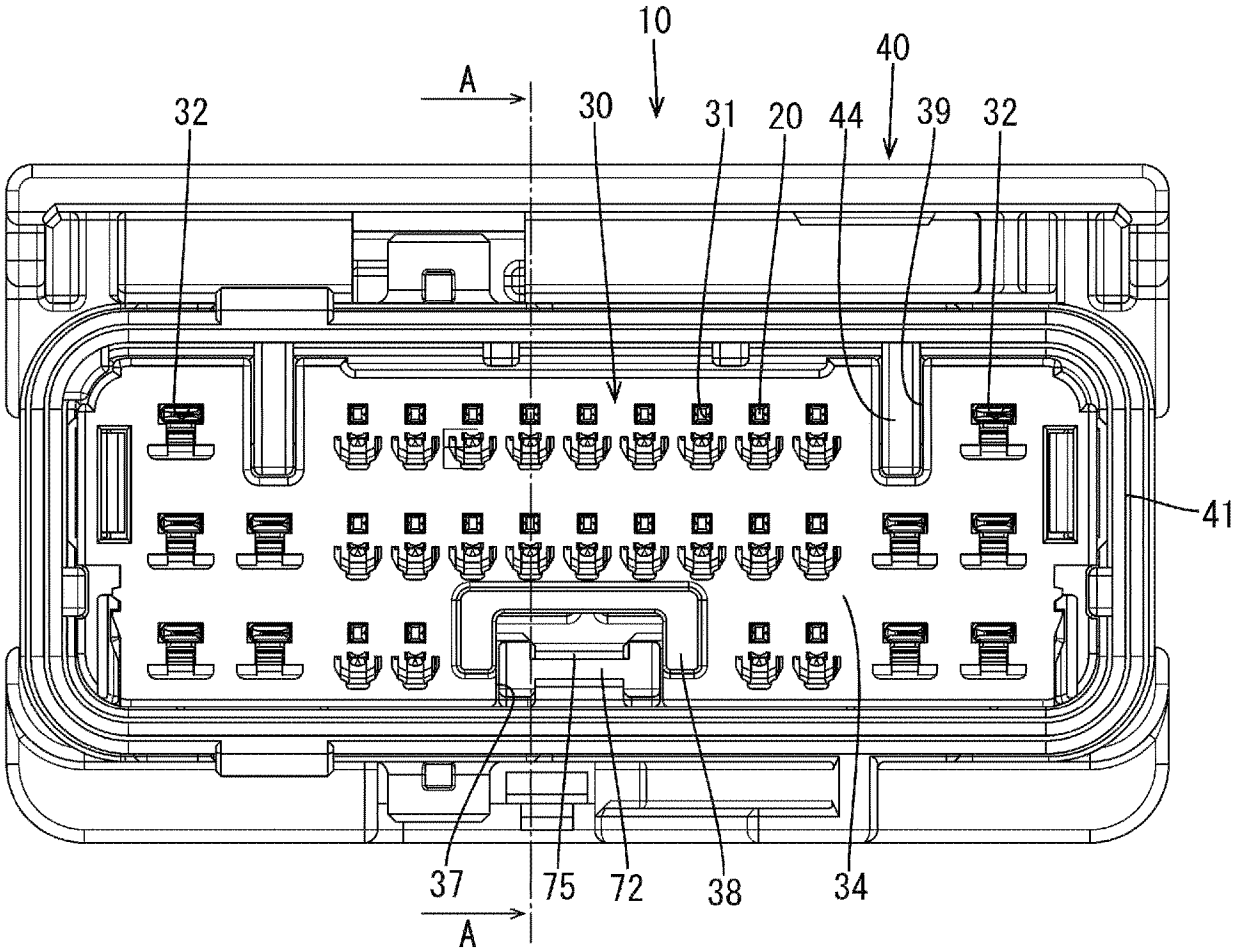
FIG. 3 is a front view of the waterproof connector with a retainer located at a partial locking position.

The outer housing 40 of the waterproof connector 10 has a laterally long rectangular shape in a front view as shown in FIG. 3 and includes a forwardly open receptacle 41, as shown in FIG. 1. The female housing 110 of the mating connector 100 is fittable into this receptacle 41. On the other hand, the inner housing 30 to be fit into the outer housing 40 includes a terminal accommodating portion 34 in the form of a substantially rectangular block, as shown in FIG. 4.

As shown in FIG. 3, large and small male cavities 31, 32 are provided in the terminal accommodating portion 34. The respective male cavities 31, 32 are disposed at positions corresponding to the respective female cavities 111, 112 of the female housing 110. The small male cavities 31 are disposed side by side in the vertical and lateral directions in a central part of the terminal accommodating portion 34, and the large male cavities 32 are disposed at both left and right sides of a group of the small male cavities 31. The large male cavities 32 are larger than the small male cavities 31, but have substantially the same structure as the small male cavities 31. In the following description, the small male cavities 31 are described as representatives and are referred to generally as male cavities 31.

Figure 4:
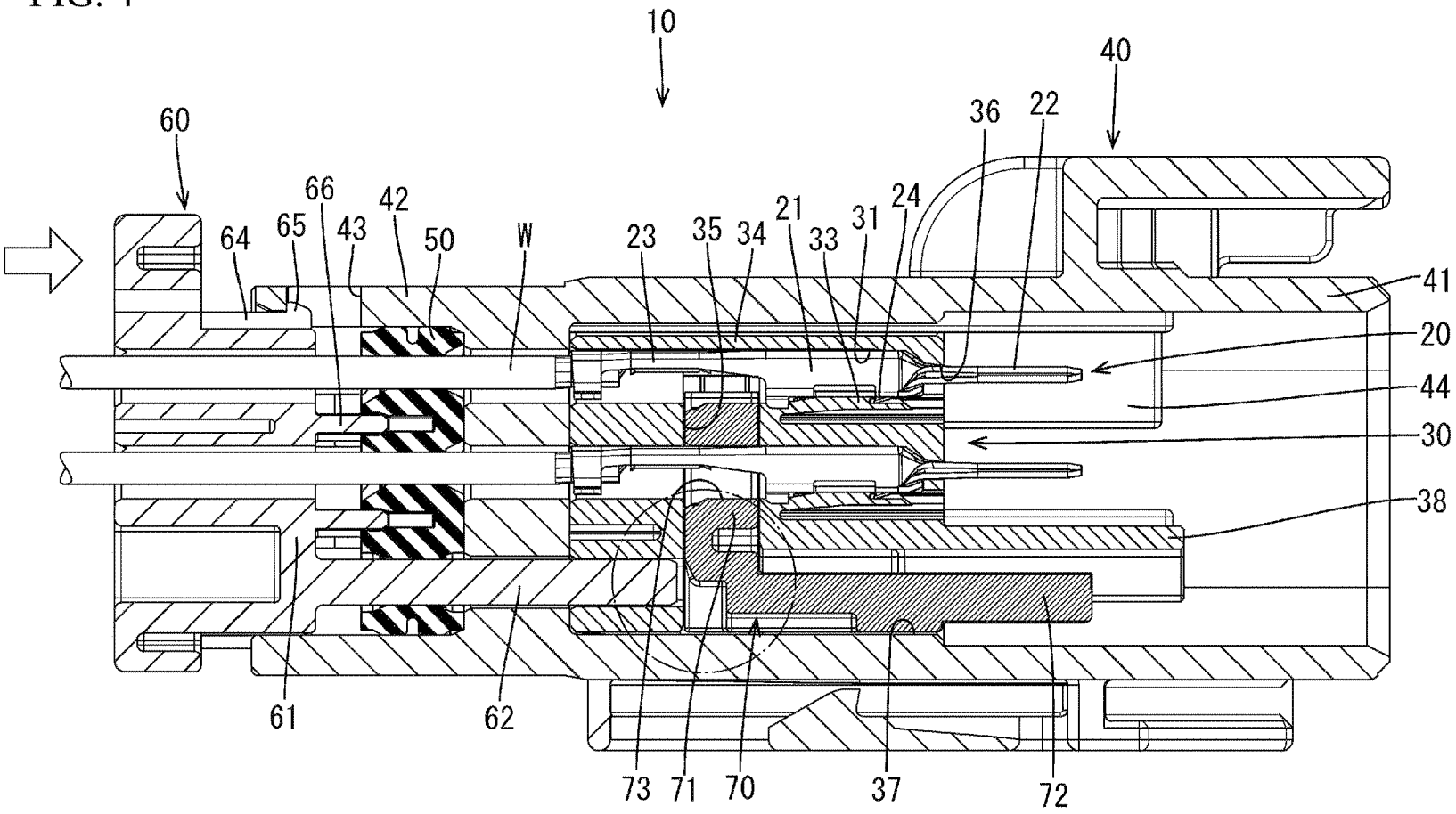
FIG. 4 is a section along A-A of FIG. 3.

As shown in FIG. 4, the male terminal 20 includes a box-shaped body 21, a contact 22 projecting forward from the front end of the body 21 and a wire connecting portion 23 provided behind the body 21. The wire connecting portion 23 is crimped and connected to a core of a wire W. Thus, the wire W extends rearward from the wire connecting portion 23.

A locking projection 24 is provided on a front part of the lower surface of the body 21. On the other hand, a forwardly cantilever locking lance 33 is provided at the bottom surface of the male cavity 31. The locking lance 33 locks the locking projection 24 from behind. In this way, the male terminal 20 is retained not to come out rearward. However, with the miniaturization of the male terminal 20, a locking margin between the locking projection 24 and the locking lance 33 becomes smaller. Thus, a sufficient holding force cannot be ensured only by the locking lance 33. Therefore, a holding force for the male terminal 20 is improved by locking the rear end of the body 21 by the retainer 70 in this embodiment.

The retainer 70 includes a lattice-shaped locking portion 71 and the releasing portion 72 projecting forward from a lower part of the locking portion 71. The locking portion 71 includes terminal insertion holes 73 that allow the passage of the male terminals 20 therethrough. As shown in FIG. 3, the releasing portion 72 is substantially H-shaped when viewed from the front. Further, the retainer 70 is mounted in the terminal accommodating portion 34 movably between a partial locking position shown in FIG. 4 and a full locking position shown in FIG. 8. In other words, the retainer 70 is a side retainer movable vertically in the direction perpendicular to a projecting direction of the contacts 22 of the male terminals 20.

The terminal accommodating portion 34 has a downwardly open retainer mount hole 35. The retainer 70 is mounted at the partial locking position with respect to the terminal accommodating portion 34 by inserting the locking portion 71 of the retainer 70 into the retainer mount hole 35 from below. Thus, the inner housing 30 is accommodated into the outer housing 40 with the retainer 70 mounted at the partial locking position.

The terminal insertion holes 73 of the locking portion 71 are coaxial with the male cavities 31 when the retainer 70 is at the partial locking position, as shown in FIG. 4. Thus, the male terminal 20 can be inserted into the male cavity 31 from behind and can be advanced through the terminal insertion hole 73 to a proper insertion position. On the other hand, the locking portion 71 is moved by about half the height of the male cavities 31 when the retainer 70 is at the full locking position, as shown in FIG. 8. Thus, the locking portion 71 is located behind the bodies 21 of the male terminals 20 and the locking portion 71 can lock the rear ends of the bodies 21 from behind. Thus, if the body 21 of the male terminal 20 moves rearward, such as when the wire W is pulled rearward, the locking portion 71 locks the body 21 to impede a rearward movement of the male terminal 20.

Further, a dimension of the locking portion 71 in the front-rear direction is about half that of the body 21 of the male terminal 20 in the front-rear direction and a sufficient shear area is ensured. Further, a locking margin between the locking portion 71 and the body 21 of the male terminal 20 is larger than that between the locking lance 33 and the locking projection 24. Thus, the holding force for the male terminal 20 by the retainer 70 is sufficiently larger than the holding force for the male terminal 20 by the locking lance 33.

Contact insertion holes 36 are provided in the front wall of the terminal accommodating portion 34 at positions corresponding to the male cavities 31 in to allow passage of the contacts 22 of the male terminals 20 therethrough. When the male terminals 20 are mounted properly into the terminal accommodating portion 34, the contacts 22 pass through the respective contact insertion hole 36 to project forward from the front wall of the male cavity 31. The contact 22 of the male terminal 20 is surrounded over the entire circumference by the receptacle 41 of the outer housing 40, and the front end of the contact 22 is behind the opening of the receptacle 41.

Further, the releasing portion 72 of the retainer 70 projects forward through a lower through hole 37 in a lower end part of the terminal accommodating portion 34. The front end of the releasing portion 72 substantially aligns with the front ends of the contact portions 22 of the male terminals 20 in the front-rear direction.

The protection wall 38 is between the contacts 22 of the male terminals 20 and the releasing portion 72. The protection wall 38 projects forward from an edge on the front end of the lower through hole 37 of the terminal accommodating portion 34. As shown in FIG. 3, the protection wall 38 has a downwardly open U-shape when viewed from front. Further, a lateral dimension of the protection wall 38 is substantially equal to that of five male cavities 31, and a vertical dimension of the protection wall 38 is substantially equal to that of the male cavities 31 in the lowermost stage.

A dimension between opposed facing side surfaces of the protection wall 38 is substantially equal to or somewhat larger than a lateral dimension of the releasing portion 72. Further, a vertical dimension of the inner surface of the protection wall 38 is substantially equal to that of the releasing portion 72. The lower half of the releasing portion 72 projects down from the protection wall 38 at the partial locking position shown in FIG. 3, and the releasing portion 72 is substantially entirely accommodated inside the protection wall 38 at the full locking position shown in FIG. 7.

Figure 10:
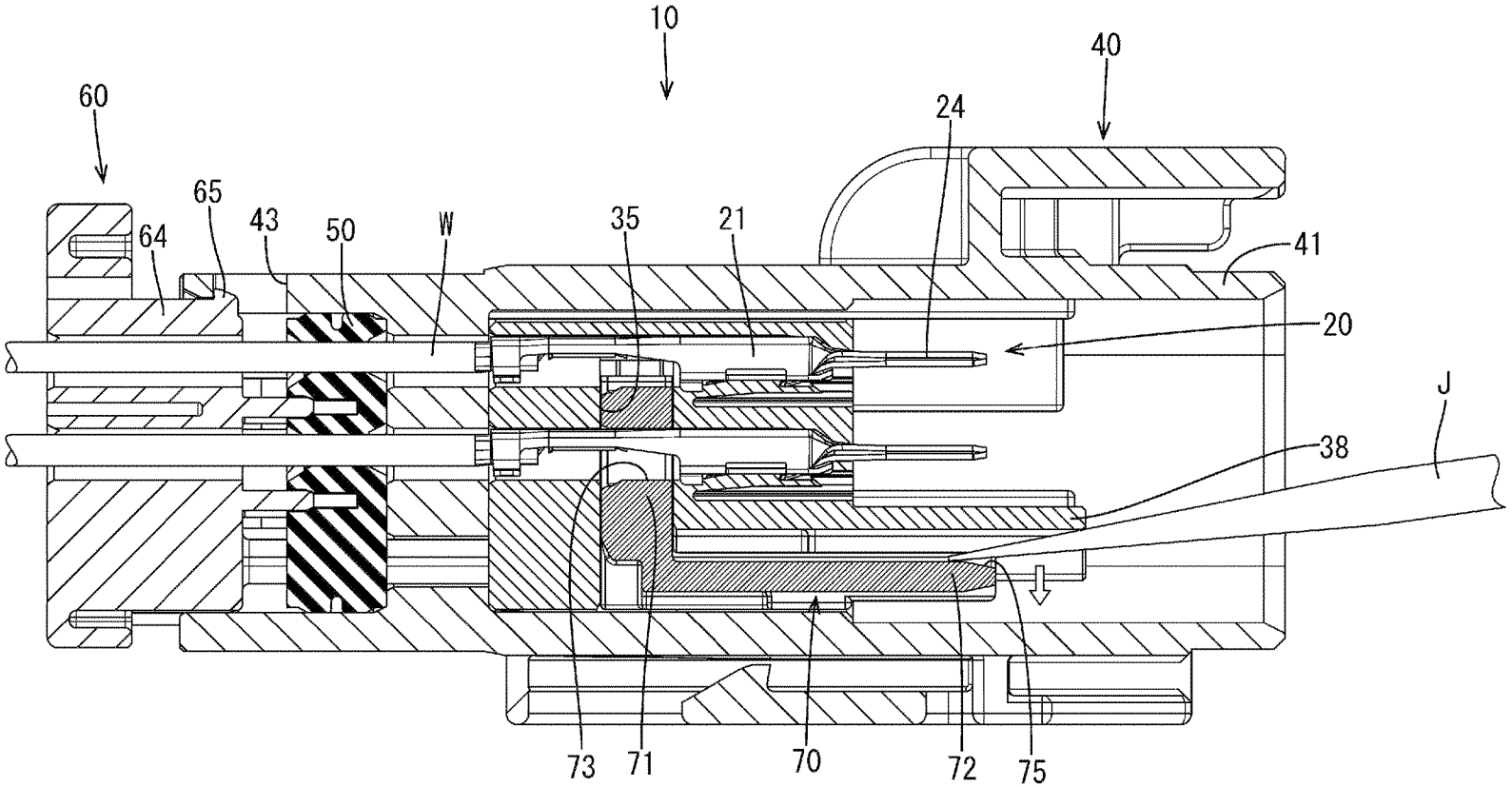
FIG. 10 is a section showing a state where the retainer is moved from the full locking position to the partial locking position by bringing the tip of a tool into contact with a releasing portion.

As shown in FIG. 10, a tool inserting portion 75 is provided in a front end part of the releasing portion 72 and can receive the tip of a tool J. The retainer 70 is moved from the full locking position to the partial locking position by inserting the tip of the tool J into the tool inserting portion 75 and lowering the tip of the tool J down (in an arrow direction of FIG. 10). At this time, the upper surface of the tool J may be placed on a front end part of the protection wall 38 and the tip of the tool J may be lowered using the principle of leverage.

A mounting portion 42 is provided in a rear part of the outer housing 40 and can receive the one-piece rubber plug 50 and the rear holder 60. The mounting portion 42 is disposed behind the terminal accommodating portion 34 and opens rearward. The rear holder 60 includes a rubber plug retaining portion 61 for locking the one-piece rubber plug 50 from behind. An operation pin 62 projects forward from a lower part of the front surface of the rubber plug retaining portion 61 and passes through the one-piece rubber plug 50. The operation pin 62 is located behind the locking portion 71 of the retainer 70 at the partial locking position, as shown in FIG. 4, and is located below the locking portion 71 of the retainer 70 at the full locking position, as shown in FIG. 8. Further, the front end of the operation pin 62 substantially contacts with the rear end of the releasing portion 72 at the full locking position shown in FIG. 8.

Figure 5:
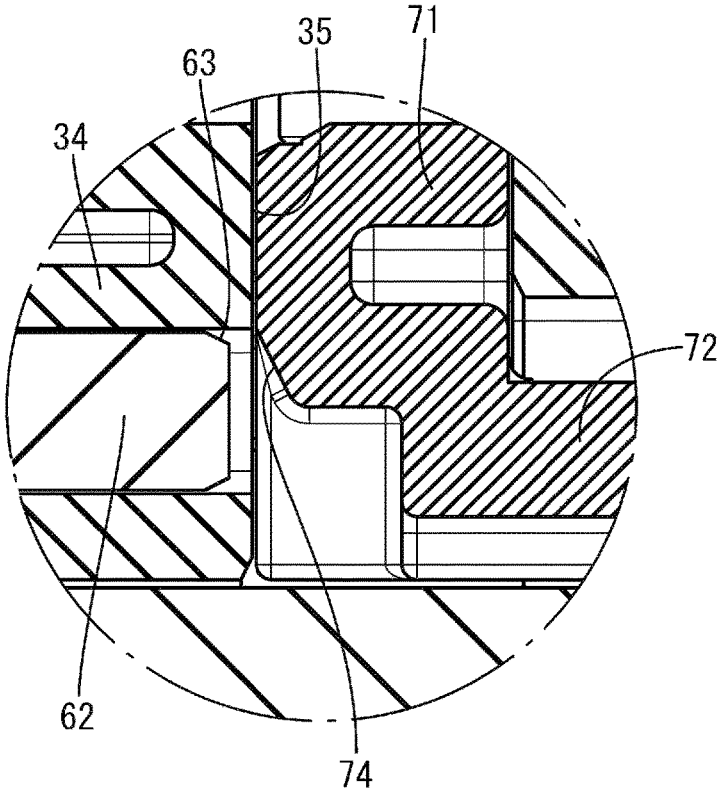
FIG. 5 is a section enlargedly showing a part encircled by a dashed-dotted line of FIG. 4.
Figure 6:
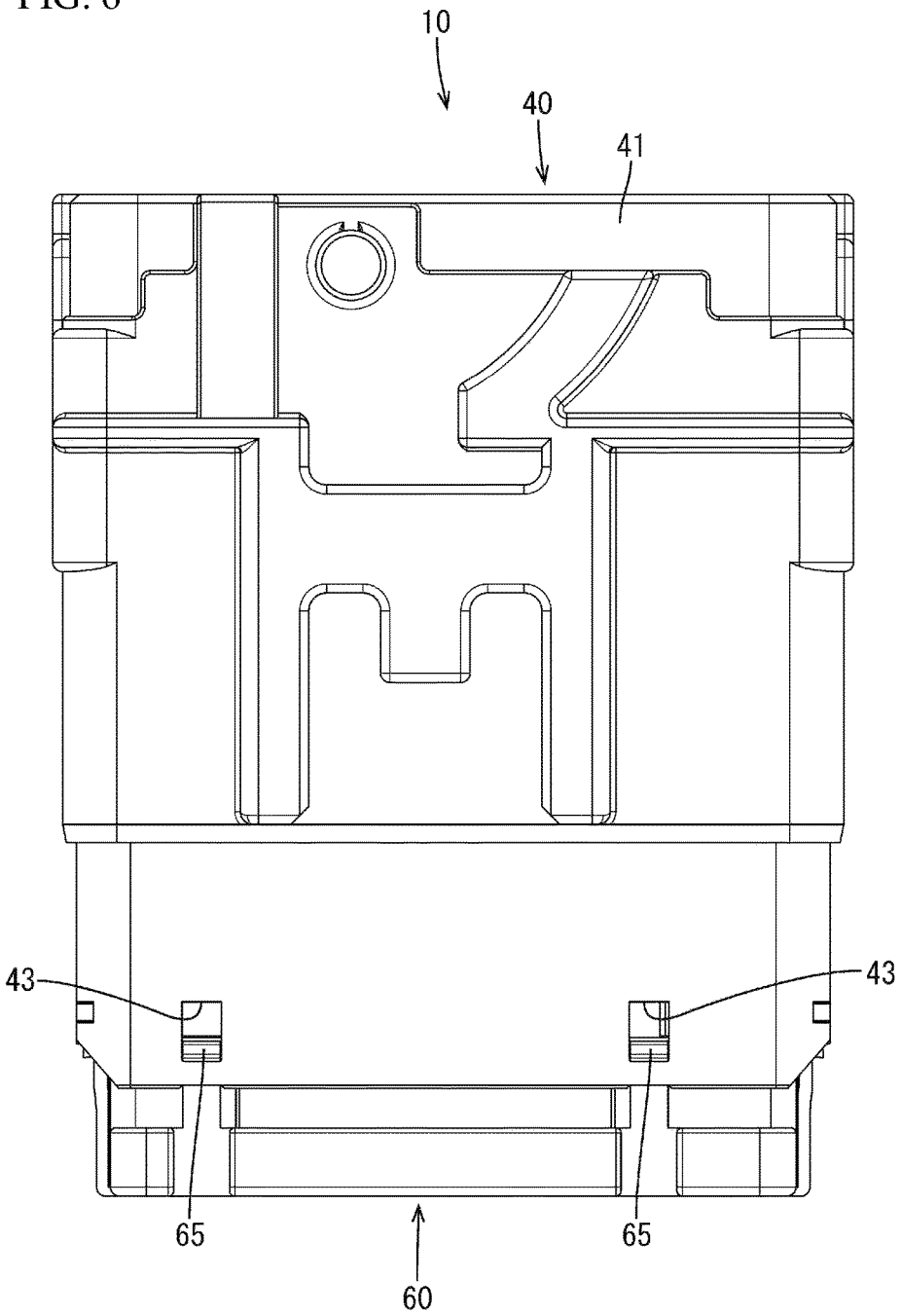
FIG. 6 is a bottom view of the waterproof connector.
Figure 7:
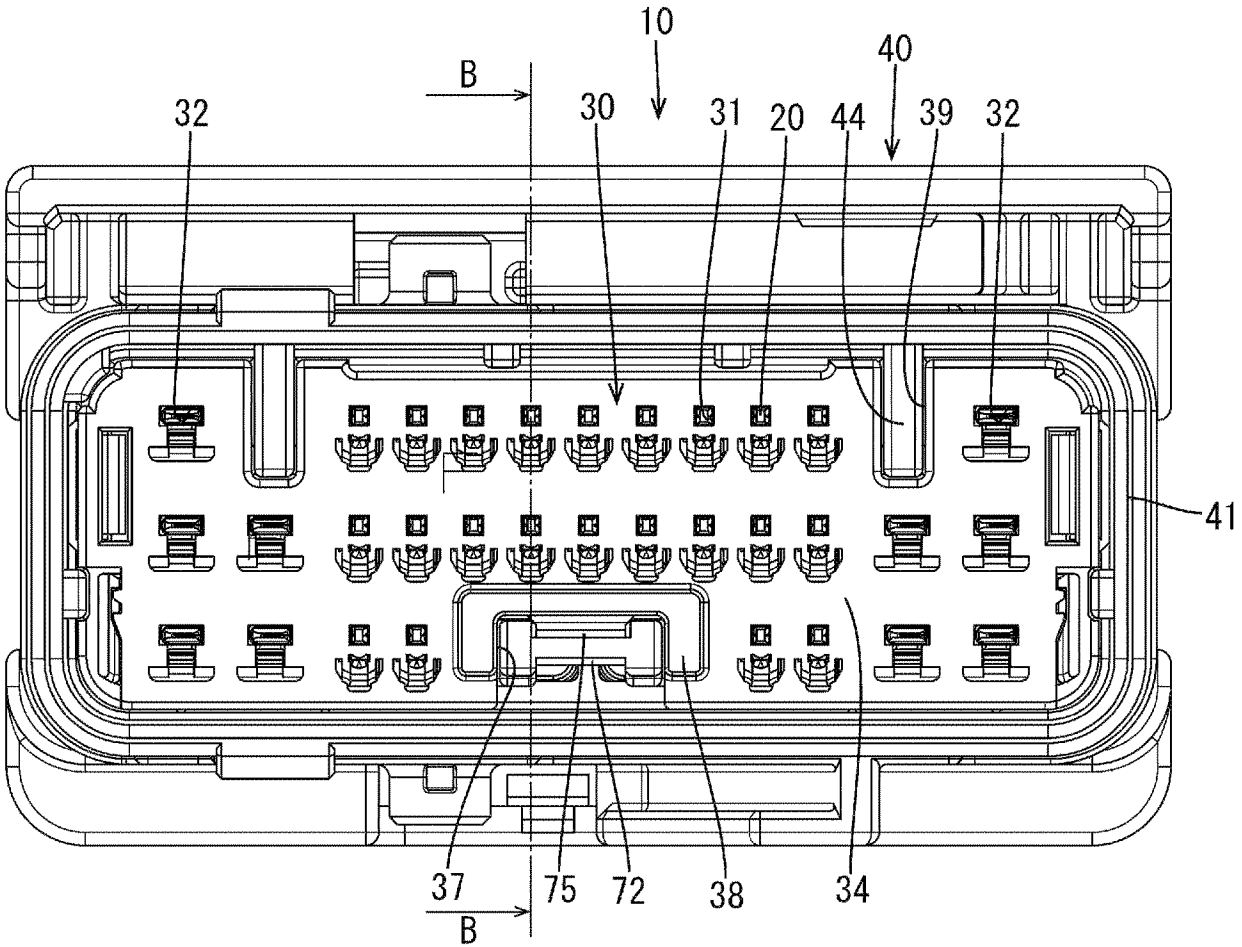
FIG. 7 is a front view of the waterproof connector with the retainer located at a full locking position.
Figure 9:
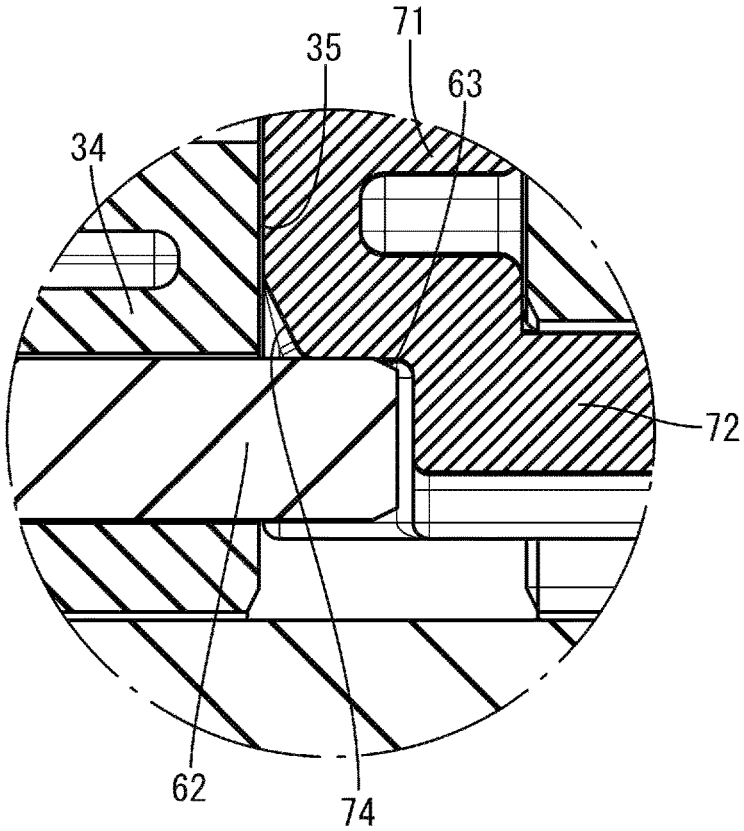
FIG. 9 is a section enlargedly showing a part encircled by a dashed-dotted line of FIG. 8.

As shown in FIG. 5, a tapered engaging portion 63 is provided circumferentially on the front end of the operation pin 62. On the other hand, an engaged portion 74 is provided on a lower end part of the locking portion 71 of the retainer 70 and is engageable with the engaging portion 63. When the rear holder 60 is pushed forward, the operation pin 62 moves forward and the engaging portion 63 of the operation pin 62 engages the engaged portion 74 of the retainer 70 so that the retainer 70 moves from the partial locking position to the full locking position. Thus, as shown in FIG. 9, the front end of the operation pin 62 is inserted below the locking portion 71 of the retainer 70. Further, as shown in FIG. 8, the one-piece rubber plug 50 is retained by the rubber plug retaining portion 61.

Left and right mounting pieces 64 are provided on upper and lower sides of the rear holder 60. On the other hand, left and right mounting holes 43 are provided in upper and lower sides of the mounting portion 42. Mounting projections 65 project out on tips of the mounting pieces 64 and are movable in the front-rear direction in the mounting holes 43. The mounting projections 65 that are at the rear ends of the mounting holes 43 lock to the rear end walls of the mounting holes 43, as shown in FIG. 4, and retain the rear holder 60. Although not clearly shown, holding pieces are provided on left and right sides of the rear holder 60 and the rear holder 60 is held at a position shown in FIG. 8 by locking the two holding pieces to holding projections provided on both left and right sides of the mounting portion 42.

Figure 11:
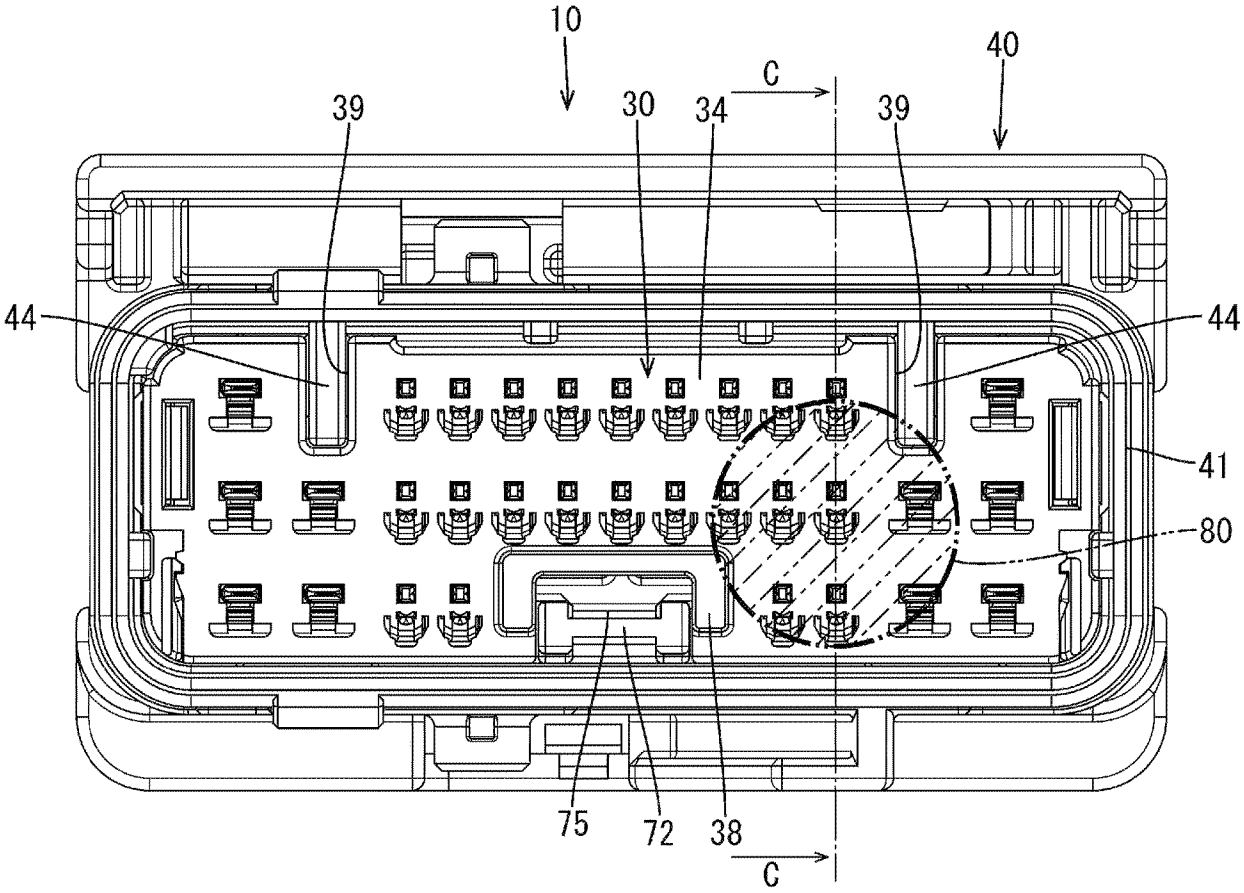
FIG. 11 is a front view showing a state where a test finger is placed on the waterproof connector.

As shown in FIG. 11, left and right erroneous assembly preventing ribs 44 are provided on the upper surface of the inner periphery of the receptacle 41 of the outer housing 40. On the other hand, left and right erroneous assembly preventing grooves 39 are provided in the terminal accommodating portion 34 of the inner housing 30 and can receive the erroneous assembly preventing ribs 44. This can prevent the inner housing 30 from being assembled erroneously in a vertically inverted posture with the receptacle 41 of the outer housing 40.

Figure 12:
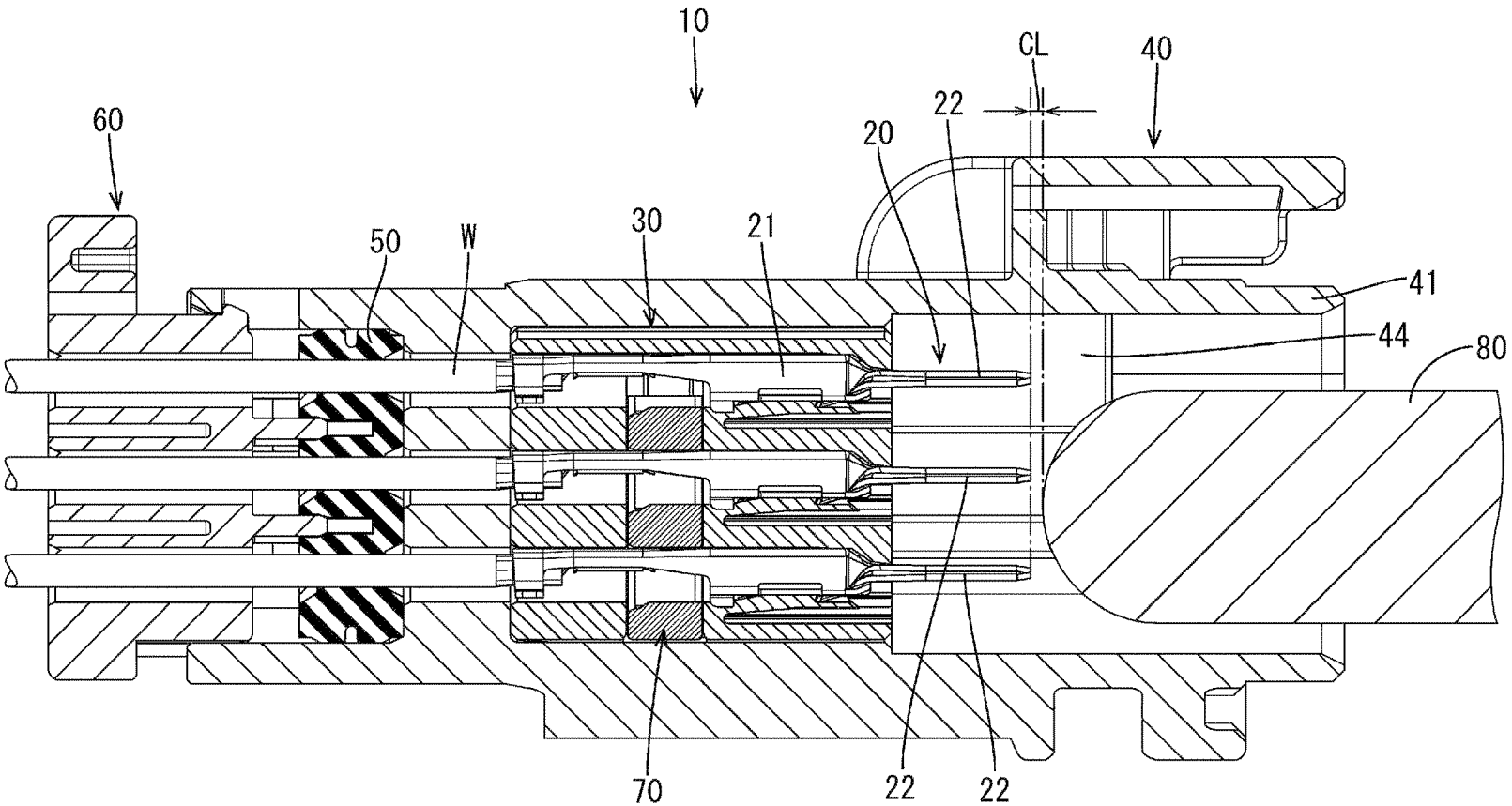
FIG. 12 is a section along C-C of FIG. 11.

A chain double-dashed line shown in FIG. 11 indicates a test finger 80. The test finger 80 contacts both the protection wall 38 and the erroneous assembly preventing rib 44 when being inserted into the receptacle 41 from the front so that a predetermined clearance CL is ensured between the tip of the test finger 80 and the tips of the contacts 22 of the male terminals 20, as shown in FIG. 12. Thus, the tip of the test finger 80 does not contact the tips of the contacts 22 of the male terminals 20. Therefore, the protection wall 38 and the erroneous assembly preventing rib 44 prevent finger contact.

The waterproof connector 10 is assembled by initially mounted the retainer 70 at the partial locking position with respect to the terminal accommodating portion 34 of the inner housing 30. Subsequently, the inner housing 30 is accommodated into the receptacle 41 of the outer housing 40 and is mounted at a predetermined position. The wires W are inserted through the rear holder 60 and the one-piece rubber plug 50 before the wire connecting portions 23 of the male terminals 20 are crimped to the wires W.

The male terminals 20 then are connected to the ends of the wires W and are inserted into the mounting portion 42 of the outer housing 40 from behind. Additionally, the bodies 21 of the male terminals 20 are accommodated into the male cavities 31 of the terminal accommodating portion 34. The locking lances 33 lock the locking projections 24 from behind when the male terminals 20 reach proper insertion positions. Thus, the male terminals 20 are retained and held in the male cavities 31.

Subsequently, the one-piece rubber plug 50 mounted on the wires W in advance is mounted into the mounting portion 42 from behind. The rear holder 60 then is mounted into the mounting portion 42 from behind, the one-piece rubber plug 50 is compressed by compression pins 66 of the rear holder 60. Thus, the one-piece rubber plug 50 is held in close contact with each wire W and the inner wall of the mounting portion 42 and the entrance of water into the interior of the outer housing 40 from behind can be avoided.

Simultaneously with this, the operation pin 62 of the rear holder 60 moves forward and the engaging portion 63 of the operation pin 62 engages the engaged portion 74 of the retainer 70, whereby the retainer 70 moves from the partial locking position to the full locking position. In this way, the male terminals 20 are doubly locked by the locking portion 71 of the retainer 70 and the locking lances 33. The waterproof connector 10 is assembled in this way.

In checking waterproof performance of the waterproof connector 10, a test is conducted to inject air into the interior of the outer housing 40. At this time, it is judged that waterproof performance is satisfied if there is no air leakage from the interior of the outer housing 40 and an inner pressure of the outer housing 40 is not lower than a predetermined pressure. However, in injecting air into the interior of the outer housing 40, the rear holder 60 may possibly move rearward together with the one-piece rubber plug 50. Since the rear holder 60 and the retainer 70 are not interlocked in this embodiment, the retainer 70 is maintained at the full locking position and a reduction of the holding force for the male terminals 20 can be avoided even if such a situation occurs.

Note that the retainer 70 is moved from the full locking position to the partial locking position by inserting the tool J from front of the receptacle 41 and lowering the tip of the tool J placed on the releasing portion 72 downwardly. At this time, since the tip of the tool J is accommodated inside the protection wall 38, the contact portions 22 of the male terminals 20 are not damaged by the tip of the tool J.

As described above, in this embodiment, the locking portion 71 can be moved and the body portions 21 can be released from locking by inserting the tool J from front of the outer housing 40 and operating the releasing portion 72. Thus, it is not necessary to provide the outer housing 40 with a hole for the releasing operation and waterproof performance can be ensured.

Further, since the retainer 70 to be mounted into the terminal accommodating portion 34 in the direction perpendicular to the projecting direction of the contact portions 22 of the male terminals 20 (so-called side retainer) can be used, the holding force for the male terminals 20 can be drastically improved as compared to the case where a retainer to be mounted into the terminal accommodating portion 34 from front (so-called front retainer) is used.

In the case of inserting the tool J from front of the outer housing 40, the contact portions 22 of the male terminals 20 may be damaged such as due to the interference of the tip of the tool J with the contact portions 22. However, since the protection wall 38 is disposed between the contact portions 22 of the male terminals 20 and the releasing portion 72 in the above configuration, the releasing portion 72 can be moved inside the protection wall 38 and a situation where the tip of the tool J erroneously contacts and damages the contact portions 22 of the male terminals 20 can be avoided.

The retainer 70 may be mounted into the terminal accommodating portion 34 from below, the releasing portion 72 may project forward through the lower through hole 37 provided in the lower end part of the terminal accommodating portion 34 and the protection wall 38 may have a gate shape open downward when viewed from front.

In the case of moving the releasing portion 72 to release the male terminals 20, the locking portion is moved from a position behind the male terminals 20 to an intermediate position between pairs of adjacent male terminals 20. Thus, an interval between the pairs of male terminals 20 adjacent across the locking portion 71 accordingly becomes larger. Generally, a locked portion to be locked by a locking portion is provided on an upper or lower side of a body portion of a male terminal in many cases, and an interval between a pair of male terminals adjacent in the vertical direction is larger than an interval between a pair of male terminals adjacent in the lateral direction. Thus, if a releasing direction of the locking portion 71 is aligned with the vertical direction, the vertical interval does not drastically become larger and drastic enlargement of the terminal accommodating portion 34 can be avoided.

The outer housing 40 may include the mounting portion 42 disposed behind the terminal accommodating portion 34 and open rearward, and a seal member (one-piece rubber plug 50) may be held in the mounting portion 42 by mounting the rear holder 60 behind the seal member in the mounting portion 42. According to this configuration, the seal member can be held in the mounting portion 42 by the rear holder 60 and the interior of the outer housing 40 can be reliably sealed by the seal member.

The retainer 70 may be movable between the full locking position for locking the body portions 21 of the male terminals 20 to hold the body portions 21 inside the terminal accommodating portion 34 and the partial locking position for permitting the insertion and withdrawal of the male terminals 20. According to this configuration, the retainer 70 can be moved from the full locking position to the partial locking position by operating the releasing portion 72 by the tool J.

The rear holder 60 may include the operation pin 62 configured to move the retainer 70 from the partial locking position to the full locking position by engaging the retainer 70 from behind. According to this configuration, the retainer 70 can be moved from the partial locking position to the full locking position only by mounting the rear holder 60 into the mounting portion 42 and an operation of moving the retainer 70 from the partial locking position to the full locking position is not necessary. Further, the operation pin 62 of the rear holder 60 can be arranged by effectively utilizing a dead space formed behind the releasing portion 72.

The invention is not limited to the above described and illustrated embodiment. For example, the following various modes are also included.

Although the protection wall 38 is open down in the above embodiment, a hollow cylindrical protection wall may be used.

The retainer 70 is mounted into the terminal accommodating portion 34 from below in the above embodiment. However, the retainer may be mounted laterally.

The interior of the outer housing 40 is sealed by a one-piece rubber plug 50 in the above embodiment. However, each male cavity 31, 32 may be sealed by an individual rubber plug.

Although the retainer 70 is movable between the partial and full locking positions in the above embodiment, the partial locking position may not be set.

The illustrated rear holder 60 includes the operation pin 62 configured to engage the retainer 70 in the above embodiment. However, the rear holder may include no operation pin.

LIST OF REFERENCE SIGNS

10 . . . waterproof connector
20 . . . male terminal
21 . . . body
22 . . . contact
30 . . . inner housing
34 . . . terminal accommodating portion
37 . . . lower through hole
38 . . . protection wall
40 . . . outer housing
42 . . . mounting portion
50 . . . one-piece rubber plug (seal)
60 . . . rear holder
62 . . . operation pin
70 . . . retainer
71 . . . locking portion
72 . . . releasing portion

What is claimed is:

1. A waterproof connector, comprising:

a male terminal having a box-shaped body and a tab-shaped contact projecting forward from a front end of the body;

an inner housing including a terminal accommodating portion;

an outer housing having the inner housing accommodated inside;

a retainer mounted into the terminal accommodating portion and including a locking portion configured to lock the body accommodated inside the terminal accommodating portion from behind; and a seal configured to seal an interior of the outer housing;

the retainer including a releasing portion projecting forward of the terminal accommodating portion; and the inner housing including a protection wall disposed between the contact of the male terminal and the releasing portion.

2. The waterproof connector of claim 1, wherein:

the retainer is mounted into the terminal accommodating portion from below;

the releasing portion projects forward through a lower through hole provided in a lower end part of the terminal accommodating portion; and the protection wall has a U-shape open downward when viewed from the front.

3. The waterproof connector of claim 2, wherein the outer housing includes a mounting portion disposed behind the terminal accommodating portion and open rearward, and the seal is held in the mounting portion by mounting a rear holder behind the seal in the mounting portion.

4. The waterproof connector of claim 3, wherein the retainer is movable between a full locking position for holding the body of the male terminal inside the terminal accommodating portion by locking the body and a partial locking position for permitting the male terminal to be inserted and withdrawn.

5. The waterproof connector of claim 4, wherein the rear holder includes an operation pin configured to move the retainer from the partial locking position to the full locking position by engaging the retainer from behind.

6. The waterproof connector of claim 1, wherein the outer housing includes a mounting portion disposed behind the terminal accommodating portion and open rearward, and the seal is held in the mounting portion by mounting a rear holder behind the seal in the mounting portion.

7. The waterproof connector of claim 1, wherein the retainer is movable between a full locking position for holding the body of the male terminal inside the terminal accommodating portion by locking the body and a partial locking position for permitting the male terminal to be inserted and withdrawn.

8. The waterproof connector of claim 7, wherein the rear holder includes an operation pin configured to move the retainer from the partial locking position to the full locking position by engaging the retainer from behind.

* * * * *